US008698384B2

(12) United States Patent
Morioka et al.

(10) Patent No.: US 8,698,384 B2
(45) Date of Patent: Apr. 15, 2014

(54) SINTERED ELECTRODE FOR COLD CATHODE TUBE, AND COLD CATHODE TUBE AND LIQUID CRYSTAL DISPLAY DEVICE USING THE SINTERED ELECTRODE

(75) Inventors: Tsutomu Morioka, Yokohama (JP); Fumihiko Yoshimura, Yokosuka (JP); Toshiaki Suto, Yokohama (JP)

(73) Assignees: Kabushiki Kaisha Toshiba, Minato-Ku (JP); Toshiba Materials Co., Ltd., Yokohama-Shi (JP)

( * ) Notice: Subject to any disclaimer, the term of this patent is extended or adjusted under 35 U.S.C. 154(b) by 490 days.

(21) Appl. No.: 12/282,937

(22) PCT Filed: Mar. 16, 2007

(86) PCT No.: PCT/JP2007/055340

§ 371 (c)(1),
(2), (4) Date: Sep. 15, 2008

(87) PCT Pub. No.: WO2007/105821

PCT Pub. Date: Sep. 20, 2007

(65) Prior Publication Data

US 2009/0051260 A1 Feb. 26, 2009

(30) Foreign Application Priority Data

Mar. 16, 2006 (JP) ..... 2006-071926

(51) Int. Cl.
*H01J 1/00* (2006.01)
*H01J 17/06* (2006.01)
*H01J 61/09* (2006.01)

(52) U.S. Cl.
USPC ..... 313/356; 313/618

(58) Field of Classification Search
USPC ..... 313/356, 618
See application file for complete search history.

(56) References Cited

U.S. PATENT DOCUMENTS

| | | | | |
|---|---|---|---|---|
| 6,218,025 | B1 * | 4/2001 | Fromm et al. | 428/544 |
| 6,310,436 | B1 | 10/2001 | Ge et al. | |
| 2002/0047667 | A1 | 4/2002 | Yasui et al. | |
| 2008/0192176 | A1 * | 8/2008 | Aoyama | 349/65 |

FOREIGN PATENT DOCUMENTS

| | | | |
|---|---|---|---|
| CN | 1532784 | A1 | 9/2004 |
| JP | 09-283081 | A1 | 10/1997 |
| JP | 2001-176445 | A1 | 6/2001 |
| JP | 2002-289139 | A1 | 10/2002 |

(Continued)

OTHER PUBLICATIONS

Japanese Office Action, Japanese Application No. 2008-505212, dated Jan. 13, 2012 (6 pages).

*Primary Examiner* — Britt D Hanley
(74) *Attorney, Agent, or Firm* — Burr & Brown, PLLC

(57) ABSTRACT

This invention provides a sintered electrode for a cold cathode tube in a cylindrical form having a bottom part on one end and an opening part on the other end, characterized in that a lead-in wire is joined integrally to the bottom part and a requirement of d2/d1>1 is satisfied wherein d1 represents the density of the sintered electrode; and d2 represents the density of the lead-in wire. According to the sintered electrode for a cold cathode tube, the bonding strength between the sintered electrode and the lead-in wire is high, and the handleability is good. The main component of the sintered electrode is particularly preferably identical to the main component of the lead-in wire. Enhancing the density of the lead-in wire can contribute to a further improvement, for example, in reliability.

7 Claims, 7 Drawing Sheets

(56) References Cited

FOREIGN PATENT DOCUMENTS

| | | | | | |
|---|---|---|---|---|---|
| JP | 2003-059683 | A1 | | 2/2003 | |
| JP | 2003-242927 | A1 | | 8/2003 | |
| JP | 2004-178875 | A1 | | 6/2004 | |
| TW | 200606524 | A | | 2/2006 | |
| WO | WO 2005109469 | A1 | * | 11/2005 | ..... H01J 61/067 |

* cited by examiner

SINTERED ELECTRODE FOR COLD CATHODE TUBE, AND COLD CATHODE TUBE AND LIQUID CRYSTAL DISPLAY DEVICE USING THE SINTERED ELECTRODE

FIELD OF THE INVENTION

The present invention relates to a sintered electrode for a cold cathode tube, and a cold cathode tube and a liquid crystal display device comprising the sintered electrode.

BACKGROUND OF THE INVENTION

Sintered electrodes for a cold cathode tube and cold cathode tubes comprising the electrodes have hitherto been used, for example, as backlights for liquid crystal display devices. In addition to high brightness and high efficiency, a long service life has been required of the cold cathode tubes for liquid crystal display devices.

Cold cathode tubes useful as backlights for liquid crystal display devices generally have a construction comprising a glass tube having an inner surface coated with a phosphor, a very small amount of mercury and rare gas filled into the glass tube, and a lead-in wire or a lead rod (for example, a KOV foil+a high-melting point metallic lead-in wire+a dumet wire) mounted at both ends of the glass tube. In these cold cathode tubes, upon the application of voltage across both the ends, the mercury sealed into the glass tube is evaporated to release ultraviolet light which is absorbed by the phosphor to emit light.

A nickel material has hitherto been mainly used as the electrode. In the nickel electrode, however, the cathode drop voltage necessary for releasing electrons from the electrode into the discharge space is somewhat high. In addition, the service life of the lamp is likely to be lowered due to the occurrence of a phenomenon of the so-called sputtering. The sputtering phenomenon is that, during lighting of the cold cathode tube, ions collide with the electrode, and the electrode material scatters resulting in the accumulation of the scattered material, mercury and the like on the wall surface within the glass tube.

The sputtering layer formed by the sputtering phenomenon takes in mercury. Consequently, the mercury no longer can be utilized for light emission. Accordingly, lighting of the cold cathode tube for a long period of time causes an extreme lowering in the brightness of the lamp and reaches the end of the service life. For this reason, if the sputtering phenomenon could be reduced, the mercury consumption could be reduced and, thus, the service life could be prolonged even when the mercury sealing amount is identical.

Accordingly, an attempt to realize a reduction in cathode drop voltage and the suppression of the sputtering has been made. Specifically, an electrode design, in which the electrode has a closed end and is cylindrical to aim at a reduction in cathode drop voltage and sputtering suppression by holocathode effect, has recently been proposed (Japanese Patent Laid-Open No. 176445/2001 (patent document 1)). Further, the adoption, as the electrode material, of Mo (molybdenum), Nb (niobium) or the like, which can lower the cathode drop voltage by about 20 V, instead of nickel which has hitherto been, has also been proposed.

The closed-end cylindrical electrode for a cold cathode tube proposed in patent document 1 is more advantageous in a reduction in cathode drop voltage and the service life than the conventional nickel electrode. The closed-end cylindrical electrode, however, suffers from a problem that, since the closed-end cylindrical shape is formed from a plate material (generally having a thickness of about 0.07 to 0.2 mm) by drawing, the yield of the material is poor, and, for metals having poor drawability, for example, cracking occurs during drawing. Drawing of the plate material is also disadvantageous in that the cost is high.

In order to overcome the above problems, Japanese Patent Laid-Open No. 178875/2004 (patent document 2) proposes a closed-end cylindrical shape using a sinter of Mo or the like.

[Patent document 1] Japanese Patent Laid-Open No. 176445/2001

[Patent document 2] Japanese Patent Laid-Open No. 178875/2004

[Patent document 3] Japanese Patent Laid-Open No. 242927/2003

SUMMARY OF THE INVENTION

Problems to be Solved by the Invention

Certainly, the formation of the closed-end cylindrical shape using the sinter can realize a significant reduction in cost as compared with drawing of the plate material. In general, a lead-in wire is welded to the bottom part of the closed-end cylindrical electrode through a KOV foil (a Kovar foil). In the welding step of the lead-in wire, however, troublesome steps such as registration and high-frequency heating are necessary, and a satisfactory reduction in cost could not have been always realized.

In order to overcome this problem, Japanese Patent Laid-Open No. 242927/2003 (patent document 3) proposes an assembly of a lead-in wire and an electrode which have been molded integrally by injection molding. The integrally molded assembly produced by injection molding, however, was unsatisfactory in bonding strength between the lead-in wire and the electrode.

Means for Solving the Problems

The present invention has been made with a view to solving the above problems of the prior art.

According to the present invention, there is provided a sintered electrode for a cold cathode tube in a cylindrical form having a bottom part on one end and an opening part on the other end, characterized in that a lead-in wire is joined integrally to the bottom part and a requirement of $d2/d1>1$ is satisfied wherein d1 represents the density of the sintered electrode; and d2 represents the density of the lead-in wire.

In the present invention, preferably, the main component of the sintered electrode is identical to the main component of the lead-in wire. The sintered electrode is preferably composed mainly of at least one material selected from tungsten, molybdenum, niobium, tantalum, rhenium, and nickel. Preferably, the joint interface between the sintered electrode and the lead-in wire has been sinter bonded. Further, preferably, the inner face of the sintered electrode has a surface roughness (Sm) of not more than 100 μm.

The d1 density value is preferably not less than 85% and not more than 98%. The d2 density value is preferably not less than 92% and not more than 100%.

According to the present invention, there is also provided a cold cathode tube characterized by comprising: a hollow tubular light transparent bulb into which a discharge medium has been sealed; a phosphor layer provided on the inner wall face of the tubular light transparent bulb; and a pair of sintered electrodes for a cold cathode tube according to claim 1 provided at both ends of the tubular light transparent bulb.

According to the present invention, there is further provided a liquid crystal display device characterized by comprising: the above cold cathode tube; a light guide body disposed in proximity to the cold cathode tube; a reflector disposed on one side of the light guide body; and a liquid crystal display panel disposed on the other side of the light guide body.

Effect of the Invention

The sintered electrode for a cold cathode tube according to the present invention has properties favorably comparable with electrodes produced by drawing of the plate material, has high bonding strength between the lead-in wire and the electrode, can be mass produced, and can be produced at low cost. Further, the cold cathode tube and the liquid crystal display device using the electrode for a cold cathode tube according to the present invention have excellent properties.

DETAILED DESCRIPTION OF THE INVENTION

The sintered electrode for a cold cathode tube in a cylindrical form according to the present invention has a bottom part on one end and an opening part on the other end and is characterized in that a lead-in wire is joined integrally to the bottom part and a requirement of d2/d1>1 is satisfied wherein d1 represents the density of the sintered electrode; and d2 represents the density of the lead-in wire.

Figure 1:
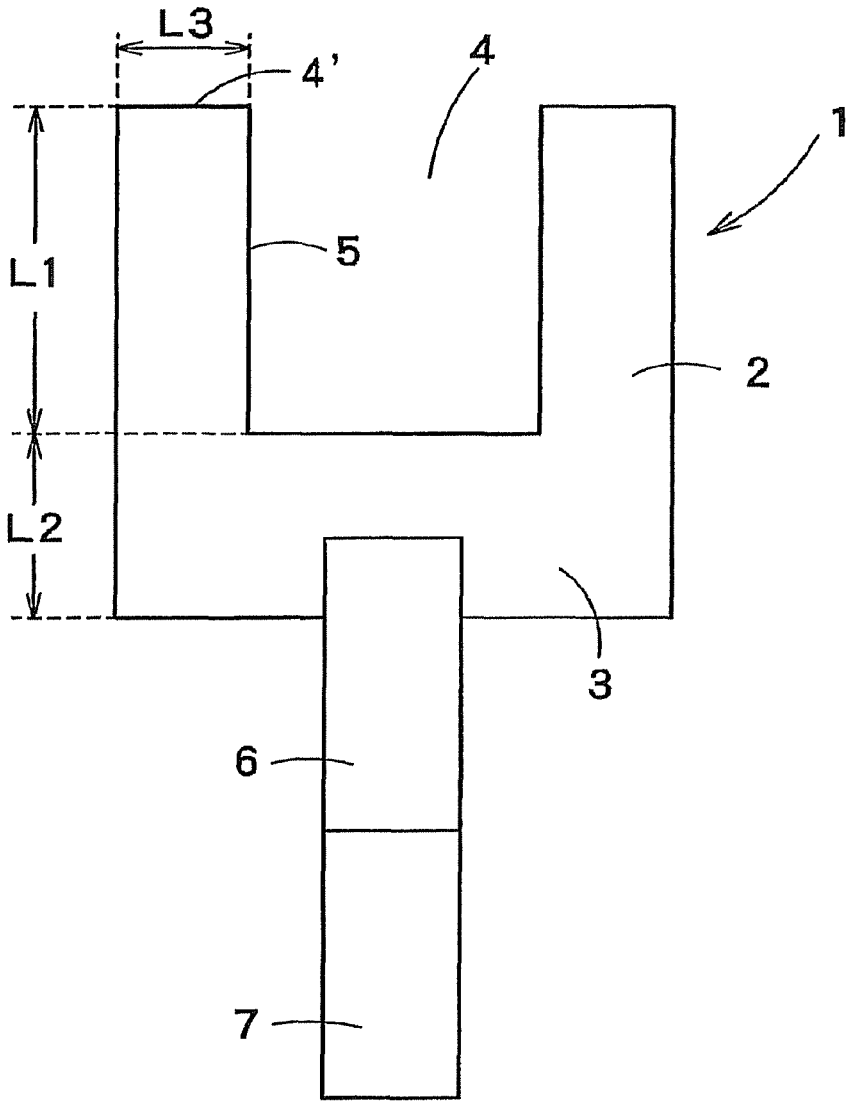
FIG. 1 is a cross-sectional view showing one embodiment of the sintered electrode for a cold cathode tube according to the present invention.

FIG. 1 is a cross-sectional view of one preferred embodiment of the sintered electrode for a cold cathode tube according to the present invention. In the drawing, numeral 1 designates a sintered electrode for a cold cathode tube, numeral 2 a side wall part of the sintered electrode, numeral 3 the bottom part of the sintered electrode, numeral 4 an opening part of the sintered electrode, numeral 5 the inner surface of the sintered electrode, numeral 6 a lead-in wire, and numeral 7 is a lead wire.

The present invention is characterized in that a requirement of d2/d1>1 is satisfied wherein d1 represents the density of the sintered electrode 1; and d2 represents the density of the lead-in wire 6. d2/d1>1 means that the density of the lead-in wire 6 is larger than the density of the sintered electrode 1, that is, the lead-in wire 6 has a higher density. The upper limit of the d2/d1 value is not particularly limited. However, the d2/d1 value is preferably is in the range of 1.81≥d2/d1>1. When the d2/d1 value exceeds 1.18, the density difference is so large that there is a possibility that the bonding strength between the sintered electrode 1 and the lead-in wire 6 is unsatisfactory. The d2/d1 value is more preferably 1.10≥d2/d1>1.

In the present invention, the density is relative density which is measured by the following method.

(1) The bottom part of the sintered electrode for a cold cathode tube is cut and removed, for example, by wire electric discharge machining to collect samples.

(2) Subsequently, the samples of the side wall part obtained by the above step (1) are half-cut axisymmetrically, for example, by wire electric discharge machining. The reason why the bottom part is cut is that, when the bottom part is present, air bubbles enter the closed space in the inside of the sintered electrode for a cold cathode tube making it impossible to conduct accurate measurement.

(3) In the samples obtained in the above step (2), the average value of data obtained by measurement of N=5 according to the Archimedes' method specified in JIS-Z-2501 (2000) is regarded as a representative value.

(4) For the density of the lead-in wire, the lead-in wire is cut into any desired length, and the average value of data obtained by the measurement of N=5 according to the Archimedes' method specified in JIS-Z-2501 (2000) is regarded as a representative value of the density.

Preferably, the density d1 of the sintered electrode 1 is not less than 85% and not more than 98%, and the density d2 of the lead-in wire 6 is not less than 92% and not more than 100%. When the density d1 of the sintered electrode 1 is less than 85%, the strength of the sintered electrode is lowered. On the other hand, when the density d1 exceeds 98%, pores are not formed on the electrode surface and, consequently, the surface area cannot be increased. When pores are present on the electrode surface, fine concavoconvexes can be formed on the electrode surface to increase the coverage of the electron emitting material (emitter material) and, further, the bondability between the electron emitting material and the sintered electrode can be improved by the anchor effect. From the viewpoint of increasing the strength and the surface area, the density d1 is preferably 90 to 96%.

The density d2 of the lead-in wire 6 is preferably 92 to 100%. The lead-in wire 6 is a place which is a sealing part in the mounting onto the cold cathode tube. Specifically, a sealing material such as glass bead is coated, and the coating is heated and fixed onto a tubular light transparent bulb (for example, a glass tube) to produce a cold cathode tube. When the density d2 of the lead-in wire is less than 92%, the density d2 of the lead-in wire 6 is unsatisfactory and, thus, the airtightness of the cold cathode tube could not be satisfactorily kept. Further, when the density of the lead-in wire 6 is low, the bonding strength between the lead-in wire 6 and the sintered electrode 1 is low. When the airtightness and the bonding strength are taken into consideration, the density d2 is preferably 97 to 100%.

The sintered electrode for a cold cathode tube according to the present invention is preferably composed mainly of a high-melting point metal. For example, the high-melting point metal is at least one metal selected from metals as a single substance, i.e., W (tungsten), Nb (niobium), Ta (tantalum), Ti (titanium), Mo (molybdenum), and Re (rhenium), and alloys of these metals. Examples of preferred alloys include W—Mo alloys, Re—W alloys, and Ta—Mo alloys.

The sintered electrode for a cold cathode tube may contain an electron emitting material (an emitter material). Electron emitting materials include, for example, rare earth oxides such as La (lanthanum), Ce (cerium), and Y (yttrium), rare earth carbonates (particularly preferably "rare earth element (R)-carbon (C)-oxygen (O) compounds"), and oxides of light elements such as Ba (barium), Mg (magnesium), and Ca (calcium). If necessary, the electron emitting material may be mixed with the high-melting point metal. A very small amount (for example, not more than 1% by mass) of Ni (nickel), Cu (copper), Fe (iron), or P (phosphorus) may be added as a sintering aid. In general, in the production process of a cold cathode tube, a nitrogen gas is used, for example, in replacement. Molybdenum-type or tungsten-type materials are more preferred than niobium-type and tantalum-type materials. In the molybdenum-type and tungsten-type materials, the molybdenum-type materials are more preferred particularly because sintering proceeds at low temperatures.

The average diameter of crystal grains of the sinter (sintered electrode 1) is preferably not more than 100 μm. The aspect ratio (major axis/minor axis) of crystal grains of the sinter is preferably not more than 5.

The material for the lead-in wire 6 is preferably composed of a high-melting point metal. For example, the material for the lead-in wire 6 is at least one metal selected from W (tungsten), Nb (niobium), Ta (tantalum), Ti (titanium), Mo (molybdenum), and Re (rhenium), and alloys of these metals. As described below, in the molding of the sintered electrode 1, the lead-in wire 6 is integrally molded followed by sintering. Accordingly, the lead-in wire 6 is preferably formed of a high-melting point metal. When this fact is taken into consideration, the lead-in wire 6 should be formed of a material having a melting point equal to or above the melting point of the main component of the sintered electrode 1.

The sintered electrode according to the present invention is characterized in that the lead-in wire 6 has been joined integrally to the bottom part 3 in the sintered electrode 1. The expression "joined integrally" means that, unlike the prior art, the materials are jointed to each other without the interposition of a brazing material such as a KOV (Kovar) foil. In this case, the sintered electrode 1 and the lead-in wire 6 can be sinter bonded to each other by molding a molded product, for the sintered electrode 1, before sintering integrally with the lead-in wire 6 and sintering the assembly. In the case of sinter bonding, metallic bonding (joining) is formed. When the main component of the sintered electrode 1 is identical to the main component of the lead-in wire 6, a stronger joined state can be realized.

In the "integral joining," preferably, the front end of the lead-in wire 6 is not extended through the bottom part 3. When the front end of the lead-in wire 6 is not extended through the bottom part 3, the area of contact between the bottom part 3 and the front end of the lead-in wire 6 is increased, and, thus, the bonding strength between the bottom part 3 and the front end of the lead-in wire 6 can be further improved.

As described above, the sintered electrode for a cold cathode tube according to the present invention has a cylindrical side wall part, a bottom part at one end of the side wall part, and an opening part at the other end of the side wall part. In this case, the surface roughness (Sm) of the inner surface of the electrode is preferably not more than 100 μm.

In the present invention, the "surface roughness (Sm)" is based on "mean spacing of profile irregularities (concavoconvexes) (Sm)" specified in JIS B 0601 (1994). Specifically, the "surface roughness (Sm)" means a surface roughness determined by a method in which "the portion equal to the reference length 1 is sampled from a roughness curve in the direction of its mean line, and within this sampled portion, the sum of the lengths of mean lines corresponding to one of the profile peaks and one profile valley adjacent to it is obtained and the arithmetical mean value of many spacings of these irregularities is expressed in millimeter (mm)."

[Numerical formula 1]

$$Sm = \frac{1}{n}\sum_{i=1}^{n} Smi$$

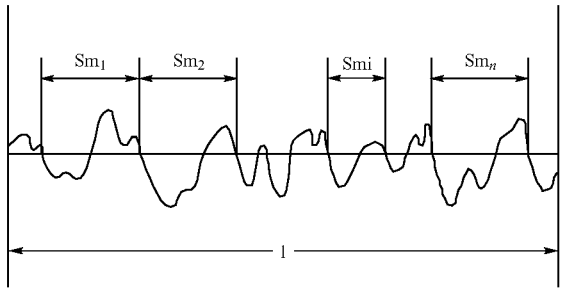

FIGS. 1 and 2 to 5 are cross-sectional views showing preferred embodiments of the sintered electrodes for a cold cathode tube according to the present invention. Each of the diagram shows a cross section parallel to a longitudinal axis direction of the sintered electrode for a cold cathode tube.

The sintered electrode 1 for a cold cathode tube shown in FIG. 1 comprises a cylindrical side wall part 2, a bottom part 3 at one end of the side wall part 2, and an opening part 4 at the other end of the side wall part 2. The surface roughness (Sm) of the inner surface 5 of the electrode is not more than 100 μm. In this specification, as shown in FIG. 1, the term "side wall part" refers to a part, in the sintered electrode 1 for a cold cathode tube, extended from the deepest part (that is, a part where the distance (L1) between the opening part 4 in its edge face 4' and the inner wall surface of the electrode is largest) to the edge face 4'. The term "bottom part" refers to a part, in the sintered electrode 1 for a cold cathode tube, extended from the above deepest part to the end of the sintered electrode remote from the edge face 4'. The inner surface 5 refers to both the inner surface of the cylindrical side wall part 2 in the sintered electrode 1 for a cold cathode tube and the inner surface of the bottom part 3.

In the present invention, the surface roughness of the inner surface 5 is preferably in a predetermined Sm range. In the present invention, each area in the inner surface 5 is not required to be always an identical Sm value. Further, in the present invention, substantially the whole area (preferably an area of not less than 30%, particularly preferably not less than 50% of the inner surface 5) of the inner surface 5 is may be in a predetermined Sm range, and the whole area of the inner surface 5 is not always required to fall within a predetermined Sm range. Accordingly, in some cases, the area of a part of the inner surface 5 may not be in a predetermined Sm range.

On the other hand, regarding the outer surface of the sintered electrode 1 for a cold cathode tube (that is, including, for example, the outer surface of the cylindrical side wall part 2, the outer surface of the bottom part 3 and the surface of the edge face 4'), the Sm value is not specified. Specifically, the Sm of the outer surface of the sintered electrode 1 for a cold cathode tube may be any arbitrary value and may be the same or different from the above Sm range specified on the inner surface of the sintered electrode 1 for a cold cathode tube.

In the specification, the "thickness" of the bottom part refers to the distance (L2) between the deepest part and the outer surface of the bottom part of the sintered electrode for a cold cathode tube. The "thickness" of the side wall part refers to the distance (L3) between the inner surface and outer surface of the sintered electrode for a cold cathode tube.

The lead-in wire 6 is joined integrally to the bottom part 3 of the sintered electrode 1 for a cold cathode tube. A lead wire 7 may be joined to the front end of the lead-in wire 6. The lead wire 7 is preferably formed of a material, which can be joined to the lead-in wire 6 and can realize continuity as a lead wire, for example, dumet wires and nickel wires.

In the sintered electrode for a cold cathode tube according to the present invention, as described above, the surface roughness (Sm) of the inner surface is preferably not more than 100 μm. The reason for this is that, in a closed-end electrode, particularly a larger surface of the electrode is more advantageous for lowering the operating voltage, and, in particular, discharge occurs at a part including the inner side of the electrode, and, thus, increasing the surface area on the inner side of the electrode is preferred. When the Sm value exceeds 100 μm, the advantageous effect on the operating voltage is poor. Further, in this case, the mercury consumption is likely to be significantly increased. This makes it difficult to attain the object of the present invention, that is, to provide a cold cathode tube which has a low operating voltage, a significantly reduced mercury consumption, and a prolonged service life. The Sm range is preferably not less than 30 μm and not more than 90 μm, particularly preferably not less than 40 μm and not more than 50 μm.

The surface roughness (Sm) of the inner surface can be provided by setting production conditions of a sinter (for example, the particle diameter of a raw material powder) so as to provide a sintered electrode having the above inner surface, or by, after the production of the sinter, subjecting the sinter to suitable treatment (for example, polishing such as barrel polishing and blasting, and etching).

The average thickness of the side face part is preferably not less than 0.1 mm and not more than 0.7 mm. The reason for this is that, in the operation of the cold cathode tube comprising the sintered electrode, when the average thickness is less than 0.1 mm, problems such as insufficient strength and pore formation occur. When the average thickness exceeds 0.7 mm, the surface area of the inner side of the sintered electrode for a cold cathode tube is reduced and, consequently, the effect of reducing the operating voltage is unsatisfactory. The average thickness of the side face part is preferably not less than 0.3 mm and not more than 0.6 mm, particularly preferably not less than 0.35 mm and not more than 0.55 mm.

On the other hand, the average thickness of the bottom part is preferably not less than 0.25 mm and not more than 1.5 mm. This is because, since the inner side of the bottom part in the electrode is significantly consumed, a thickness of more than 0.25 mm is preferred. However, when the average thickness of the bottom part exceeds 1.5 mm, the surface area of the inner side is reduced and, consequently, as with the above case, the effect of reducing the operating voltage is unsatisfactory. The average thickness of the bottom part is preferably not less than 0.4 mm and not more than 1.35 mm, particularly preferably not less than 0.6 mm and not more than 1.15 mm.

The length of the sintered electrode for a cold cathode tube according to the present invention [that is, the length between the surface of the edge face 4' and the outer surface of the bottom part farthermost from the edge face 4' (in the case where a protrusion part is present, the surface of the front end of the protrusion part)] is mainly determined, for example, by the size and properties of the cold cathode tube in which the electrode is incorporated. The length of the sintered electrode is preferably not less than 3 mm and not more than 8 mm, particularly preferably not less than 4 mm and not more than 7 mm.

The diameter of the sintered electrode for a cold cathode tube is also determined, for example, by the size and properties of the cold cathode tube in which the electrode is incorporated. The diameter of the sintered electrode is preferably not less than 1.0 mmϕ and not more than 3.0 mmϕ, particularly preferably not less than 1.3 mmϕ and not more than 2.7 mmϕ.

The ratio of the length of the sintered electrode for a cold cathode tube to the diameter of the sintered electrode (length/diameter) is preferably not less than 2 and not more than 3, particularly preferably not less than 2.2 and not more than 2.8.

Figure 2:
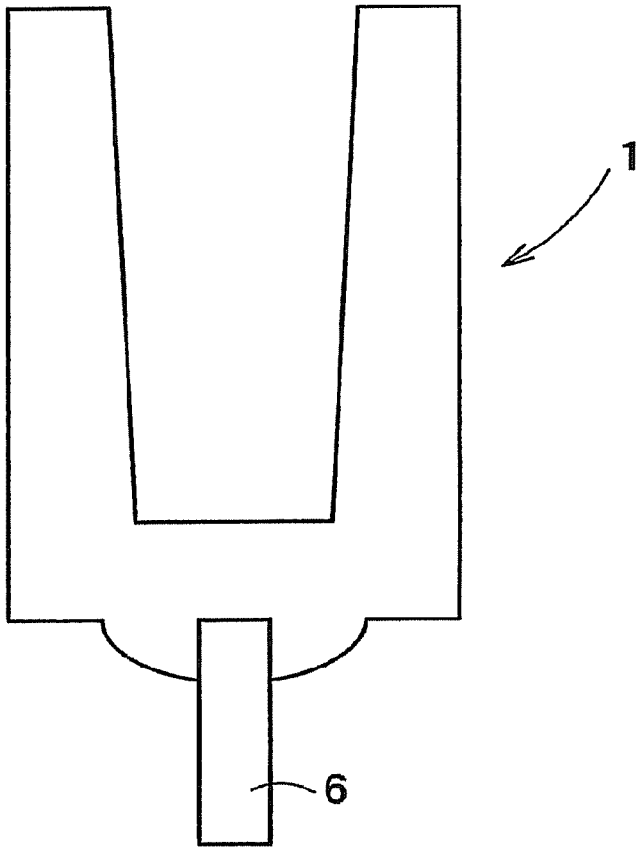
FIG. 2 is a cross-sectional view showing another embodiment of the sintered electrode for a cold cathode tube according to the present invention.
Figure 3:
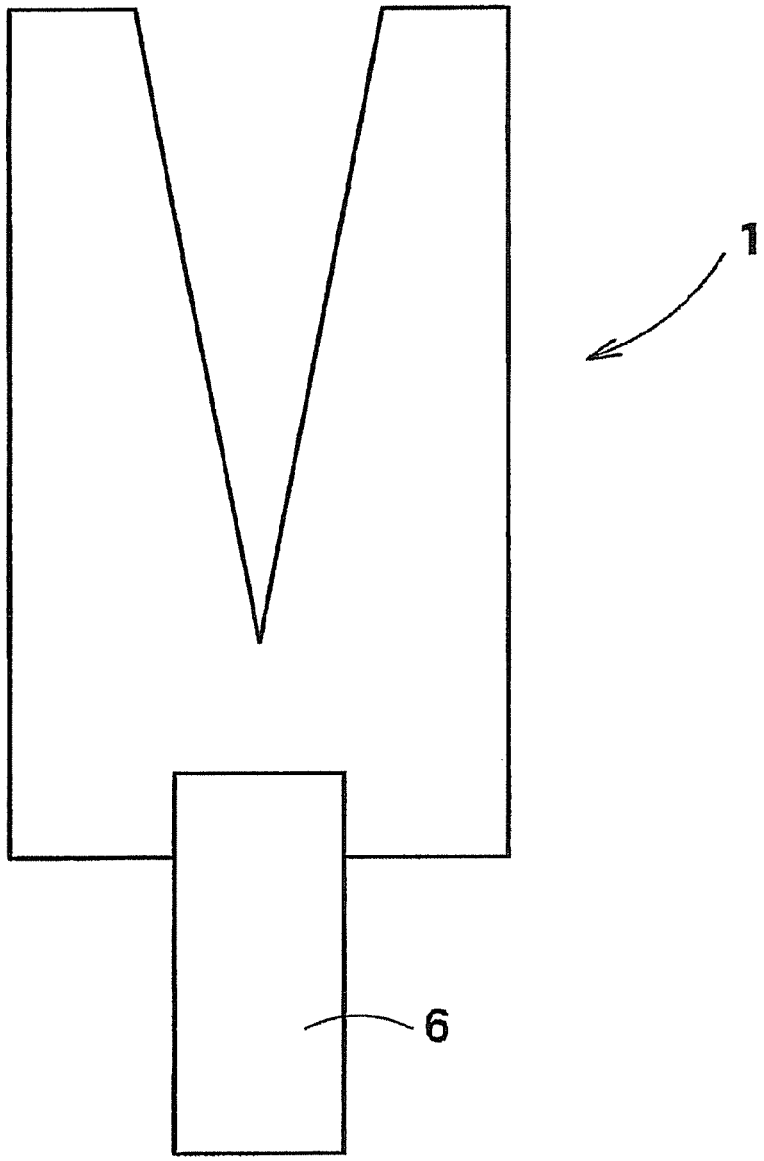
FIG. 3 is a cross-sectional view showing still another embodiment of the sintered electrode for a cold cathode tube according to the present invention.
Figure 4:
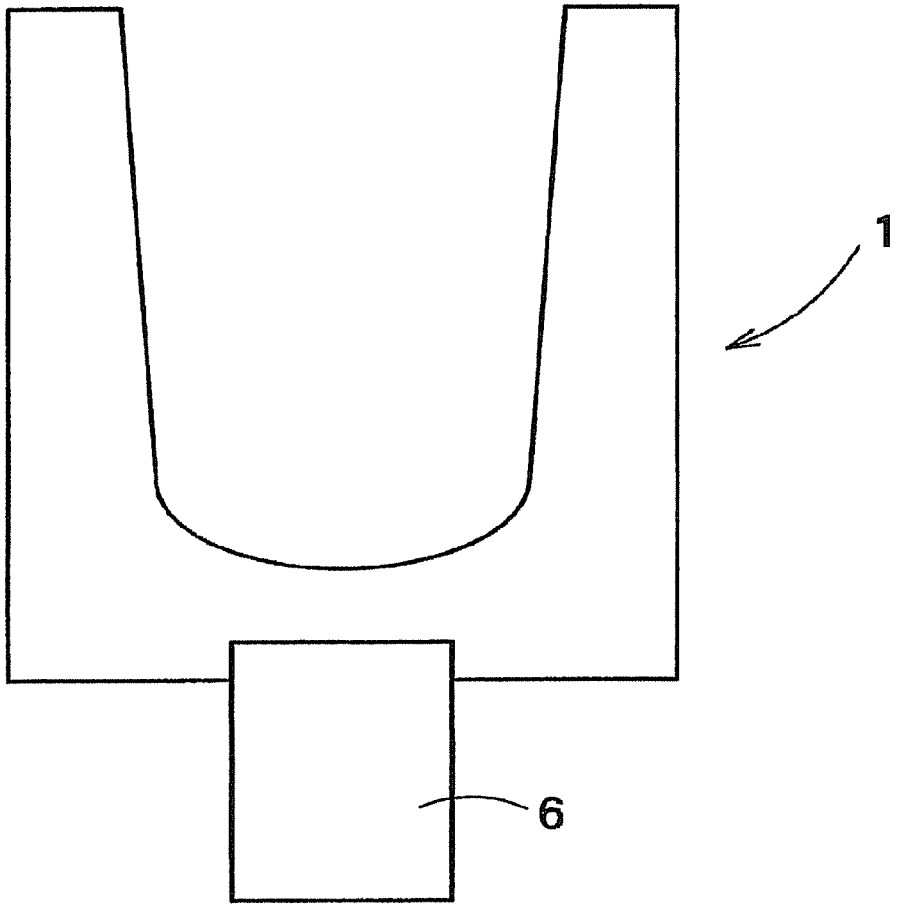
FIG. 4 is a cross-sectional view showing a further embodiment of the sintered electrode for a cold cathode tube according to the present invention.
Figure 5:
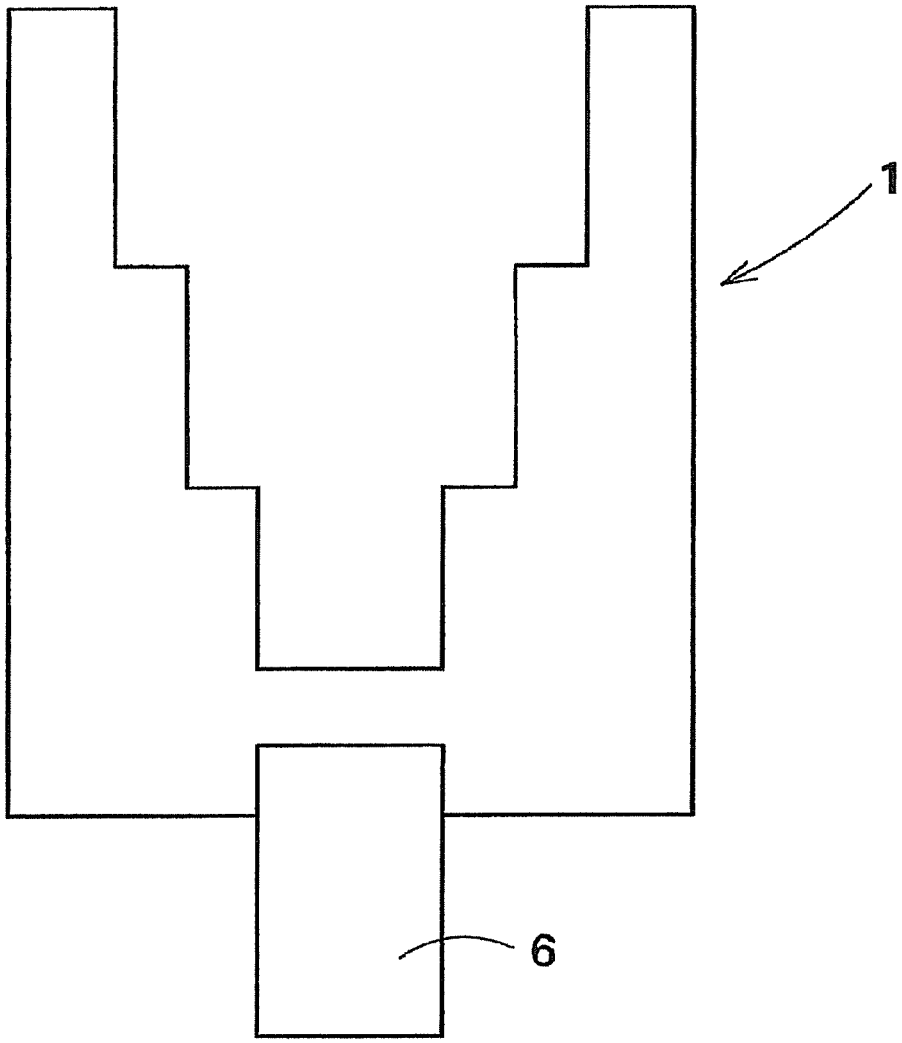
FIG. 5 is a cross-sectional view showing a still further embodiment of the sintered electrode for a cold cathode tube according to the present invention.

The sintered electrode for a cold cathode tube according to the present invention should have a large surface area. Further, for example, from the viewpoints of easiness of production and fabrication and workability in the mounting of the sintered electrode on a hollow bulb in the production of the cold cathode tube, the shape of a cylindrical internal space shown in a cross section parallel to the longitudinal axis direction is preferably a rectangular shape as shown in FIG. 1 or a trapezoidal shape as shown in FIG. 2. The shape of the cylindrical internal space is not limited to the above shapes and may be of various shapes such as V shape in section as shown in FIG. 3, U shape in section as shown in FIG. 4, and step shape in section as shown in FIG. 5. Further for the same reason, the outer shape of the side wall part is preferably cylindrical. However, other shapes (for example, elliptical and polygonal shapes) may also be adopted. The outer shape of the sintered electrode for a cold cathode tube may be different from the inner shape of the sintered electrode.

By virtue of the above construction, a cold cathode tube, which has a low operating voltage, a significantly reduced mercury consumption, and a prolonged service life can be provided. Further, unlike the prior art, there is no need to join the lead-in wire with a KOV foil, and, thus, a significant reduction in cost can be realized.

Next, the production process of a sintered electrode for a cold cathode tube according to the present invention will be described.

The production process is not particularly limited. For example, the sintered electrode for a cold cathode tube may be produced as follows. The production process will be described by taking the production of a sintered electrode composed mainly of molybdenum (Mo) as an example.

At the outset, a molybdenum wire as a lead-in wire is prepared. The molybdenum wire preferably has a density of not less than 92%. In order to bring the density to a predetermined value, a high-density sinter may be previously used. Alternatively, a wire rod produced by wire drawing may be used. In particular, the wire rod produced by wire drawing is obtained by subjecting a sintered ingot (or a melted ingot), for example, to forging, rolling, and wire drawing, and, thus, a high-density lead-in wire can easily be produced.

Next, the sintered electrode for a cold cathode tube can be produced by mixing the raw material powder, granulating the mixture, and molding the granules into a predetermined shape, and then sintering the molded product. The molybdenum powder as the raw material powder has an average particle diameter of not less than 1 μm and not more than 5 μm and a purity of not less than 99.95%. This powder is mixed with pure water and a binder (preferably polyvinyl alcohol (PVA)), and the mixture is granulated. Thereafter, the granules are molded into a cup shape (a cylindrical shape) by single press molding, rotary press molding or injection molding.

Regarding the production of a molded product, a molded product comprising a cup-shaped molded product integrated with a lead-in wire can be produced by conducting molding together with the lead-in wire. Alternatively, another process may be adopted in which a molded product is once formed, and a molded product comprising a cup-shaped molded product integrated with a lead-in wire is then produced by the step of inserting the lead-in wire into the molded product.

If necessary, a molybdenum alloy as the second component and an electron emitting material (an emitter material) may be added.

Subsequently, the molded product is degreased in a wet hydrogen of 800 to 1100° C. and is then sintered in hydrogen under conditions of 1600 to 2300° C. and 5 to 24 hr. If necessary, the sinter is subjected to hot isostatic pressing (HIP) treatment under conditions of 1300 to 1700° C. and 100 to 300 MPa. When the surface roughness of the inner side of the closed-end part is not in a predetermined Sm range, or in order to realize a more preferred Sm range, the surface roughness (Sm) of the inner side of the closed-end part can be regulated. Examples of such methods include barrel polishing and blast treatment. In this case, for example, the abrasive material and work can be properly selected and regulated. Further, in this step of sintering, the sintered electrode and the lead-in wire can be joined integrally to each other. In this case, when the main component of the sintered electrode is identical to the main component of the lead-in wire, metallic bonding occurs at the contact face between the sintered electrode and the lead-in wire. Accordingly, a stronger bond can be provided.

The assembly is then washed and annealed at a temperature of 700 to 1000° C. Thereafter, a lead wire is welded to the assembly to complete electrode assembling.

In the sintered electrode for a cold cathode tube according to the present invention, comprising the above sinter, the sintered electrode has been joined integrally to the lead-in wire. Accordingly, welding using a KOV foil or the like is unnecessary, and, thus, the cost can be reduced.

In the present invention, as described above, a cold cathode tube, which has a low operating voltage and possesses a significantly suppressed mercury consumption and a prolonged service life, can be provided. Further, a sintered electrode for a cold cathode tube, which has a bonding strength of not less than 250 $N/mm^2$ per unit sectional area of the lead-in wire, can be provided.

Figure 6:
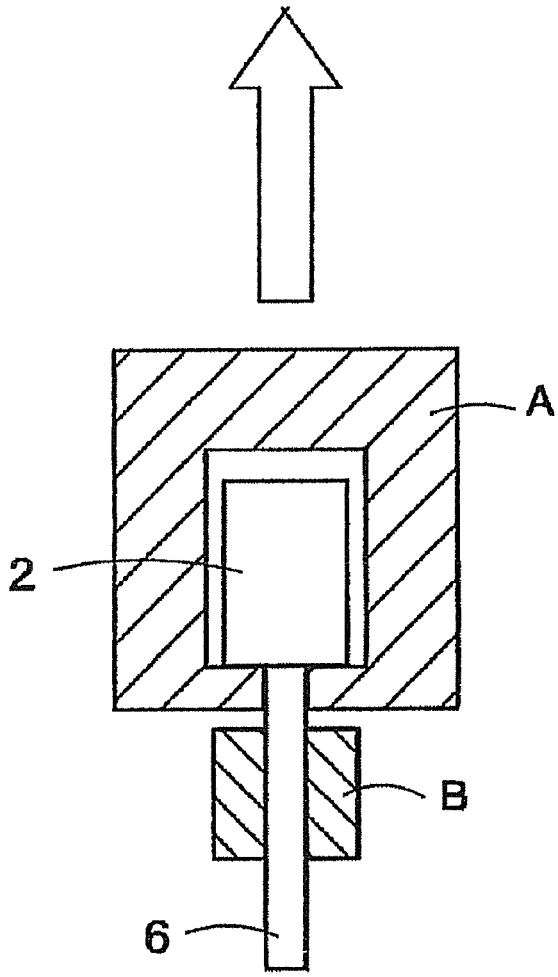
FIG. 6 is a diagram briefly showing a method for measuring the bonding strength between a lead-in wire and a sintered electrode.

As shown in FIG. 6, the bonding strength per unit sectional area of the lead-in wire is measured by fixing a sintered electrode 1 for a cold cathode tube within a slit formed in a chucking A, separately fixing a lead-in wire 6 with a chucking B, and pulling the chucking A at a speed of 10 mm/min.

Next, a production process of a cold cathode tube will be described.

The cold cathode tube according to the present invention is characterized by comprising: a hollow tubular light transparent bulb into which a discharge medium has been sealed; a phosphor layer provided on the inner wall face of the tubular light transparent bulb; and a pair of the sintered electrodes for a cold cathode tube provided at both ends of the tubular light transparent bulb. In the cold cathode tube according to the present invention, for example, discharge media, tubular light transparent bulbs, and phosphor layers, which have hitherto been used in this type of cold cathode tubes, particularly in cold cathode tubes for backlights for liquid crystal displays, either as such or after proper modification, may be used as discharge media, tubular light transparent bulbs, and phosphor layers which are indispensable as elements other than the sintered electrode for a cold cathode tube.

Examples of preferred discharge media which can be applied in the cold cathode tube according to the present invention include rare gas-mercury-type media, wherein rare gases includes argon, neon, xenon, and krypton and mixtures thereof. Examples of such phosphors include phosphors which emit light upon excitation with ultraviolet light, preferably calcium halophosphate phosphors. An example of the hollow tubular light transparent bulb is a glass tube having a length of not less than 60 mm and not more than 700 mm, a diameter of not less than 1.6 mm and not more than 4.8 mm.

The cold cathode tube according to the present invention preferably has a structure in which the lead-in wire part is sealed to the tubular light transparent bulb. Since the lead-in wire has high density, the airtightness within the bulb after sealing, for example, with glass beads can easily be kept.

Next, a liquid crystal display device will be described. The liquid crystal display device according to the present invention is characterized by comprising: the above cold cathode tube; a light guide body disposed in proximity to the cold cathode tube; a reflector disposed on one side of the light guide body; and a liquid crystal display panel disposed on the other side of the light guide body.

Figure 7:
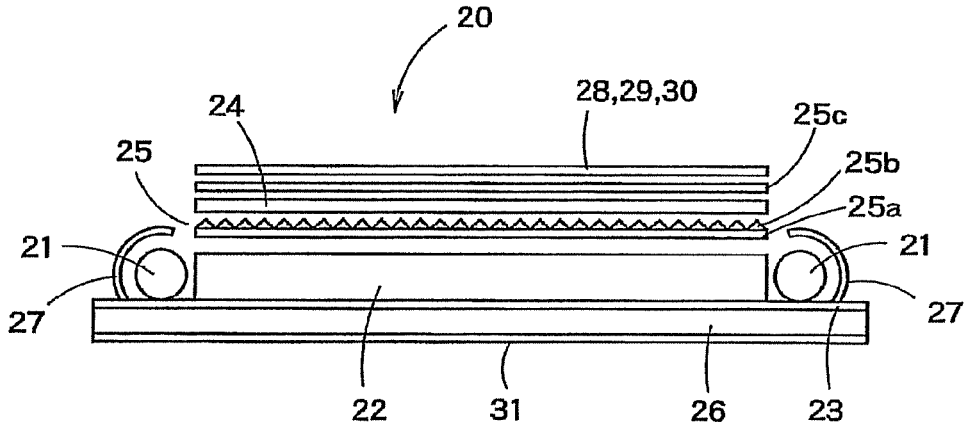
FIG. 7 is a cross-sectional view showing one embodiment of the liquid crystal display device according to the present invention.

FIG. 7 is a cross-sectional view showing one preferred embodiment of the liquid crystal display device according to the present invention.

A liquid crystal display device 20 shown in FIG. 7 comprises a cold cathode tube 21, a light guide body 22 disposed in proximity to the cold cathode tube 21, a reflector 23 disposed on one face side of the light guide body 22, and a liquid crystal display panel 24 disposed on the other face side of the light guide body 22. Further, a light diffusing material 25 is disposed between the light guide body 22 and the liquid crystal display panel 24, and a reflector 27 for a cold cathode tube for reflecting light from the cold cathode tube 21 toward the light guide body 22 is disposed.

In the present invention, the number of cold cathode tubes may be any desired one. For example, as shown in FIG. 7, two in total of cold cathode tubes 21 may be disposed in proximity to two opposed sides of the light guide body 22. Alternatively, one or at least two cold cathode tubes may be disposed in proximity to one side (or at least three sides) of the light guide body. The number and shape of the light diffusing material 25 may also be any desired one. For example, one or at least two sheet-shaped light diffusing materials 25*a* to which light diffusing properties have been imparted by allowing light diffusing particles to exist within the diffusing material, or one or at least two lens-shaped or prism-shaped light diffusing materials 25*b* to which light diffusing properties have been imparted by regulating the surface shape, may be disposed between the light guide body 22 and the liquid crystal display panel 24. If necessary, for example, a light diffusing material 25*c*, a surface protective material 28, an antireflection material 29 for preventing or reducing external light reflection or catching, and an antistatic material 30 may be provided on the liquid crystal display panel 24 in its viewer side. A construction may also be adopted in which one or at least two layers having a plurality of functions provided by combining two or more of the light diffusing materials 25*a*, 25*b*, 25*c*, the surface protective material 28, the antireflection material 29, the antistatic material 30 and the like may be provided. If a desired function is developed as a liquid crystal display device, then the light diffusing materials 25*a*, 25*b*, 25*c*, the surface protective material 28, the antireflection material 29, the antistatic material 30 and the like may not be provided. A support substrate 26 for holding each of the constituent members in the liquid crystal display device 20 (that is, for example, the cold cathode tube 21, the light guide body 22, the reflector 23, the liquid crystal display panel 24, the light diffusing materials 25*a*, 25*b*, 25*c*, the surface protective material 28, the antireflection material 29, and the antistatic material 30) at a predetermined position, a frame, a spacer, and a case for housing each of the constituent members may be provided. Further, for example, a heat radiating member 31 may also be provided.

In the liquid crystal display device according to the present invention, as with the conventional liquid crystal display device, for example, an electric wiring or LSI chip for supplying drive voltage to the liquid crystal display panel 24, an electric wiring for supplying the drive voltage to the cold cathode tube 21, and a sealing material for preventing leakage of light into unnecessary parts and the entry of dust and moisture in the interior of the apparatus may be provided at necessary sites.

In the present invention, only the cold cathode tube 21 should satisfy the predetermined requirements which have been described above in detail. On the other hand, various constituent members other than the cold cathode tube 21 (for example, the light guide body 22, the reflector 23, the liquid crystal display panel 24, the light diffusing materials 25*a*, 25*b*, 25*c*, the support substrate 26, the reflector 27 for a cold cathode tube, the surface protective material 28, the antireflective material 29, the antistatic material 30, the heat radiating member 31, the frame, the case, and the sealing material) may be those which are used in the prior art. FIG. 7 shows an example of a liquid crystal display device having a side-light-type backlight structure. In the liquid crystal display device according to the present invention, a downlight-type backlight structure may also be applied.

EXAMPLES

Examples 1 and 2

A molybdenum powder (purity not less than 99.95%) (100% by weight) having an average particle diameter of 2 μm was provided. The molybdenum powder was mixed with pure water and a PVA binder, and the mixture was granulated. Thereafter, the granules were molded by a single shot press into a cup-shaped molded product.

On the other hand, a wire-drawn molybdenum wire rod was cut into a predetermined length followed by fixation onto the bottom part of the cup-shaped molded product. The assembly was then degreased in wet hydrogen of 1000° C. Subsequently, the assembly was sintered in hydrogen under conditions of 2000° C.×12 hr. Thus, a sintered electrode for a cold cathode tube comprising the sintered electrode produced in Example 1 joined integrally to the lead-in wire and a sintered electrode for a cold cathode tube comprising the sintered electrode produced in Example 2 joined integrally to the lead-in wire were produced.

Examples 3 to 7

A wire-drawn molybdenum wire rod was cut into a predetermined length to form a lead-in wire.

Next, a molybdenum powder (purity not less than 99.95%) (100% by weight) having an average particle diameter of 2 μm was provided. The molybdenum powder was mixed with pure water and a PVA binder, and the mixture was granulated. Thereafter, the granules were molded by a single shot press into a cup-shaped molded product. In this case, molding was carried out so that the lead-in wire was fixed onto the bottom part of the molded product. The assembly was then degreased in wet hydrogen of 1000° C. Subsequently, the assembly was sintered in hydrogen under conditions of 2000° C.×12 hr. Thus, sintered electrodes for a cold cathode tube comprising each of the sintered electrodes produced in Examples 3 to 7 joined integrally to the lead-in wire were produced.

For all the Examples 1 to 7, the lead-in wire had such a shape that was not passed completely through the bottom part of the sintered electrode. All the sintered electrodes had an outer diameter of 2.3 mm and a bottom part thickness of 0.8 mm. The surface roughness (Sm) of the inner surface of the sintered electrode was not more than 80 μm. Further, the sintered electrode had an average crystal grain diameter of not more than 100 μm and an aspect ratio of 5 or less.

Comparative Example 1

A sintered electrode for a cold cathode tube of Comparative Example 1 was produced in the same manner as in Example 1, except that the joining of the lead-in wire was carried out using a KOV foil.

Comparative Example 2

A sintered electrode for a cold cathode tube of Comparative Example 2 was produced in the same manner as in Example 1, except that a molded product comprising the cup-shaped molded product joined integrally to the lead-in wire was produced by injection molding.

Comparative Example 3

A sintered electrode for a cold cathode tube of Comparative Example 3 was produced in the same manner as in Example 1, except that a relationship of $d2/d1<1$ was satisfied wherein d2 represents the density of the lead-in wire and d1 represents the density of the sintered electrode.

Cold Cathode Tubes

Cold cathode tubes were produced using the sintered electrodes for a cold cathode tube produced in the Examples and the Comparative Examples. A dumet wire was joined to the sintered electrodes for a cold cathode tube. A glass tube having a diameter (outer diameter) of 3.2 mm and an inter-electrode distance of 350 mm was used as the cold cathode tube. A glass bead was mounted onto the lead-in wire part in the sintered electrode for a cold cathode tube followed by sealing to the glass tube. The glass tube had a construction necessary as a cold cathode tube, that is, had a construction that, for example, mercury and a phosphor layer were placed within the glass tube.

The leakage-derived defective fraction, electrode dropout-derived defective fraction, and bonding strength of the lead-in wire were measured for the cold cathode tubes. For the leakage-derived defective fraction, the proportion of leak failure at the sealing part in the operation of the cold cathode tube was determined. For the electrode dropout-derived defective fraction, the proportion of dropout failure of the sintered electrode which is a phenomenon of the separation of the sintered electrode from the lead-in wire in the production of the cold cathode tube was determined. As described above, the bonding strength is the bonding strength between the sintered electrode and the lead-in wire using chuckings A and B.

The results are shown below.

[Table 1]

TABLE 1

| | Sintered electrode | | | Lead-in wire | | | | |
|---|---|---|---|---|---|---|---|---|
| | Diameter (Inner diameter) | Length | Density (d1) | Diameter | Length | Density (d2) | d2/d1 | Joint interface |
| Ex. 1 | 1.7 mm | 5 mm | 95.1 | 0.8 mm | 2.8 mm | 99.5 | 1.05 | Sinter bonding |
| Ext 2 | 1.7 mm | 4 mm | 95.1 | 0.8 mm | 2.8 mm | 99.5 | 1.05 | Sinter bonding |
| EX. 3 | 1.7 mm | 5 mm | 92.2 | 0.8 mm | 2.8 mm | 99.5 | 1.08 | Sinter bonding |
| Ex. 4 | 1.7 mm | 4 mm | 92.2 | 0.8 mm | 2.8 mm | 99.5 | 1.08 | Sinter bonding |
| Ex. 5 | 1.7 mm | 4 mm | 87.4 | 0.8 mm | 2.8 mm | 99.5 | 1.14 | Sinter bonding |
| Ex. 6 | 1.7 mm | 4 mm | 97.3 | 0.8 mm | 2.8 mm | 99.2 | 1.02 | Sinter bonding |
| Ex. 7 | 1.7 mm | 4 mm | 90.6 | 0.8 mm | 2.8 mm | 99.7 | 1.10 | Sinter bonding |
| Comp. Ex. 1 | 1.7 mm | 5 mm | 92.2 | 0.8 mm | 2.8 mm | 99.5 | 1.08 | KOV foil soldering |
| Comp. Ex. 2 | 1.7 mm | 5 mm | 92.2 | 0.8 mm | 2.8 mm | 99.2 | 1.00 | Sinter bonding |
| Comp. Ex. 3 | 1.7 mm | 5 mm | 95.1 | 0.8 mm | 2.8 mm | 89.3 | 0.94 | Sinter bonding |

TABLE 2

| | Cold cathode tube | | |
|---|---|---|---|
| | Leakage-derived defective fraction | Electrode dropout-derived defective fraction | Bonding strength |
| Ex. 1 | 2 ppm | 0 | 330 N |
| Ex. 2 | 1 ppm | 0 | 350 N |
| Ex. 3 | 3 ppm | 0 | 310 N |
| Ex. 4 | 3 ppm | 0 | 300 N |
| Ex. 5 | 5 ppm | 1 ppm | 280 N |
| Ex. 6 | 2 ppm | 0 | 360 N |
| Ex. 7 | 1 ppm | 1 ppm | 290 N |
| Comp. Ex. 1 | 15 ppm | 7 ppm | 240 N |
| Comp. Ex. 2 | 14 ppm | 5 ppm | 300 N |
| Comp. Ex. 3 | 10 ppm | 1 ppm | 280 N |

Table 1 shows the construction of sintered electrodes for a cold cathode tube, and Table 2 shows the results of the measurement.

The cold cathode tubes of the Examples use a high-density molybdenum (Mo) wire in their lead-in wire. By virtue of this, the airtightness is so high that the leakage-derived defective fraction is low. Further, since the lead-in wire was joined integrally to the sintered electrode, the electrode dropout-derived failure did not occur. On the other hand, for Comparative Example 1, joining with the KOV foil was so weak that the dropout of the sintered electrode occurred. For Comparative Example 2, the lead-in wire and the sintered electrode were injection molded into an identical molded product. In this structure, the bonding strength between the lead-in wire and the sintered electrode is so low that the lead-in wire part is likely to be broken. Further, for the bonding strength, in the sintered electrodes for a cold cathode tube of the Examples of the present invention, sinter bonding is used, and, thus, strong joined state can be achieved. In the table, the term "ppm" refers to parts per million. For example, in Example 1, a leakage-derived failure of 2 ppm means that, when 1,000,000 cold cathode tubes were produced, two leakage-derived defective failure occurred.

The sintered electrodes for a cold cathode tube and the cold cathode tubes using the sintered electrodes cause no significant occurrence of leakage-derived failure and the like, are highly reliable, are free from electrode dropout and the like, and thus have good handleability. Further, since brazing with KOV foils and the like is unnecessary, a significant reduction in cost can be realized.

The cold cathode tubes of the Examples of the present invention were used to constitute a backlight and were incorporated in liquid crystal display devices. As a result, good results could be obtained. Further, the cold cathode tube could be applied to both sidelight-type backlights and downlight-type backlights.

Examples 8 to 11

In Examples 8 to 10, sintered electrodes for a cold cathode tube were produced in the same manner as in Example 1, except that, in Example 8, the internal surface of the sintered electrode was blasted to bring the surface roughness (Sm) to 40 μm; in Example 9, the internal surface of the sintered electrode was blasted to bring the surface roughness (Sm) to 100 μm; and, in Example 10, the internal surface of the sintered electrode was blasted to bring the surface roughness (Sm) to 200 μm.

In Example 11, a sintered electrode for a cold cathode tube was produced in the same manner as in Example 8, except that 2% by weight of lanthanum oxide ($La_2O_3$) was added as an electron emitting material (an emitter material).

Cold cathode tubes were produced using each sintered electrode for a cold cathode tube. The operating voltage and the mercury evaporation amount were measured for each cold cathode tube. For the operating voltage, the initial voltage (V) necessary for lighting the cold cathode tube was measured. For the mercury evaporation amount, the amount of mercury evaporated after 10000 hr was measured. The results are shown in Table 3.

TABLE 3

| | Internal surface roughness (Sm) | Initial voltage (V) | Mercury evaporation (mg) |
|---|---|---|---|
| Ex. 1 | 80 μm | 558 | 0.29 |
| Ex. 8 | 40 μm | 546 | 0.25 |
| Ex. 9 | 100 μm | 568 | 0.34 |
| Ex. 10 | 200 μm | 588 | 0.47 |
| Ex. 11 | 40 μm | 535 | 0.22 |

As can be seen from the results, the surface roughness (Sm) of the internal surface is preferably not more than 100 μm. That is, the adoption of a structure of a sintered electrode for a cold cathode tube comprising the sintered electrode joined integrally with the lead-in wire can improve not only reliability, handleability, cost reduction but also properties as the electrode. Further, the incorporation of the electron emitting material can realize improved initial voltage and mercury evaporation amount.

Examples 12 to 18

A wire-drawn molybdenum wire rod was cut into a predetermined length to form a lead-in wire.

Next, a molybdenum powder (purity not less than 99.95%) (99% by weight) having an average particle diameter of 2 μm and 1% by weight of an $LaO_2$ powder as an emitter material were provided. They were mixed with pure water and a PVA binder, and the mixture was granulated. Thereafter, the granules were molded by a single shot press into a cup-shaped molded product. In this case, molding was carried out so that the lead-in wire was fixed onto the bottom part of the molded product. The assembly was then degreased in wet hydrogen of 900 to 1100° C. Subsequently, the assembly was sintered in hydrogen under conditions of 2000 to 2100° C.×10 to 16 hr. Thus, sintered electrodes for a cold cathode tube comprising each of the sintered electrodes produced in Examples 12 to 18 as shown in Table 4 joined integrally to the lead-in wire were produced.

For all the Examples 12 to 18, the lead-in wire had such a shape that was not passed completely through the bottom part of the sintered electrode. All the sintered electrodes had an outer diameter of 2.6 mm and a bottom part thickness of 0.8 mm. The surface roughness (Sm) of the internal surface of the sintered electrode was 30 to 70 μm. Further, the sintered electrode had an average crystal grain diameter of not more than 80 μm and an aspect ratio of 5 or less.

The leakage-derived defective fraction, electrode dropout-derived defective fraction, and bonding strength were measured for the sintered electrode for a cold cathode tube produced in each Example in the same manner as in Example 1. The results are shown in Table 5.

[Table 4]

TABLE 4

| | Sintered electrode | | | Lead-in wire | | | | |
|---|---|---|---|---|---|---|---|---|
| Example | Diameter (Inner diameter) | Length | Density (d1) | Diameter | Length | Density (d2) | d2/d1 | Joint interface |
| 12 | 1.5 mm | 4 mm | 95.3 | 0.7 mm | 2.7 mm | 100 | 1.05 | Sinter bonding |
| 13 | 1.5 mm | 7 mm | 94.2 | 0.8 mm | 2.9 mm | 99.8 | 1.06 | Sinter bonding |
| 14 | 1.6 mm | 5 mm | 92.6 | 0.9 mm | 3.0 mm | 99.5 | 1.07 | Sinter bonding |
| 15 | 1.7 mm | 5 mm | 91.7 | 0.8 mm | 2.4 mm | 99.2 | 1.08 | Sinter bonding |
| 16 | 1.7 mm | 4 mm | 95.8 | 0.7 mm | 2.6 mm | 99.5 | 1.04 | Sinter bonding |
| 17 | 1.8 mm | 5 mm | 94.5 | 0.9 mm | 2.8 mm | 99.6 | 1.05 | Sinter bonding |
| 18 | 1.9 mm | 6 mm | 93.7 | 0.8 mm | 2.8 mm | 100 | 1.07 | Sinter bonding |

TABLE 5

| | Cold cathode tube | | |
|---|---|---|---|
| | Leakage-derived defective fraction | Electrode dropout-derived defective fraction | Bonding strength |
| Ex. 12 | 3 ppm | 0 | 340 N |
| Ex. 13 | 3 ppm | 0 | 310 N |
| Ex. 14 | 2 ppm | 0 | 330 N |
| Ex. 15 | 1 ppm | 0 | 320 N |
| Ex. 16 | 1 ppm | 0 | 360 N |
| Ex. 17 | 1 ppm | 0 | 340 N |
| Ex. 18 | 1 ppm | 0 | 340 N |

As described above, the sintered electrodes of the Examples of the present invention are also effective for the sintered electrode containing an emitter material. Further, cold cathode tubes were produced in the same manner as in Example 1, except that the sintered electrodes for a cold cathode tube of Examples 12 to 18 were used. The cold cathode tubes provided good results, and the initial voltage and the mercury evaporation amount were 510 to 540 (V) and 0.19 to 0.26 (mg), respectively.

The invention claimed is:

1. A sintered electrode for a cold cathode tube in a cylindrical form having a bottom part on one end and an opening part on the other end, wherein a lead-in wire is joined integrally to the bottom part; and wherein a requirement of d2/d1>1 is satisfied, wherein d1 represents a density of the sintered electrode and is in a range of 90% to 96%, and d2 represents a density of the lead-in wire and is in a range of 92% to 100%; and wherein a joint interface between the sintered electrode and the lead-in wire is a sintered bond.

2. The sintered electrode for a cold cathode tube according to claim 1, wherein a main component of the sintered electrode is identical to the main component of the lead-in wire.

3. The sintered electrode for a cold cathode tube according to claim 1, wherein the sintered electrode is composed mainly of at least one material selected from tungsten, molybdenum, niobium, tantalum, rhenium, and nickel.

4. The sintered electrode for a cold cathode tube according to claim 1, wherein an inner face of the sintered electrode has a surface roughness (Sm) of not more than 100 μm.

5. A cold cathode tube comprising:

a hollow tubular light transparent bulb having a discharge medium sealed therein;

a phosphor layer provided on an inner wall face of the tubular light transparent bulb; and a pair of sintered electrodes for a cold cathode tube according to claim 1 provided at both ends of the tubular light transparent bulb.

6. A liquid crystal display device comprising:

a cold cathode tube according to claim 5;

a light guide body disposed in proximity to the cold cathode tube;

a reflector disposed on one side of the light guide body; and a liquid crystal display panel disposed on another side of the light guide body.

7. The sintered electrode for a cold cathode tube according to claim 1, wherein a front end of the lead-in wire does not extend through a bottom part of the sintered electrode.

* * * * *